United States Patent [19]

Gerber

[11] Patent Number: 4,580,224

[45] Date of Patent: Apr. 1, 1986

[54] METHOD AND SYSTEM FOR GENERATING AN ECCENTRICITY COMPENSATION SIGNAL FOR GAUGE CONTROL OF POSITION CONTROL OF A ROLLING MILL

[75] Inventor: Terry L. Gerber, Lisbon, Ohio

[73] Assignee: E. W. Bliss Company, Inc., Salem, Ohio

[21] Appl. No.: 521,926

[22] Filed: Aug. 10, 1983

[51] Int. Cl.[4] ..... B21B 37/00

[52] U.S. Cl. ..... 364/472; 72/6

[58] Field of Search ..... 364/472; 72/6, 8, 11, 72/20

[56] References Cited

U.S. PATENT DOCUMENTS

| | | | |
|---|---|---|---|
| 3,543,549 | 12/1970 | Howard | 72/8 |
| 3,709,009 | 1/1973 | Shiozaki | 72/8 |
| 3,881,335 | 5/1975 | Cook | 72/11 |
| 3,882,705 | 5/1975 | Fox | 72/11 |
| 3,889,504 | 6/1975 | Ichiryu | 72/8 |
| 3,928,994 | 12/1975 | Ichiryu | 72/8 |
| 4,036,041 | 7/1977 | Ichiryu | 72/8 |
| 4,052,559 | 10/1977 | Paul | 333/70 T |
| 4,126,027 | 11/1978 | Smith et al. | 72/11 |
| 4,177,430 | 12/1979 | Paul | 325/475 |
| 4,222,254 | 9/1980 | King et al. | 72/8 |
| 4,299,104 | 11/1981 | Hayama | 72/20 |

FOREIGN PATENT DOCUMENTS

| | | |
|---|---|---|
| 1540952 | 2/1979 | United Kingdom . |
| 2130748A | 6/1984 | United Kingdom . |

OTHER PUBLICATIONS

Control Equations for Dynamic Characteristics of Cold Rolling Tandem Mills; Watanaba; *Iron and Steel Engineer Year Book*, 1974.

Adaptive Digital Techniques for Audio Noise Cancelation; by James E. Paul; IEEE Circuits and Systems Magazine; vol. I, No. 4, pp. 2–7, 1979.

*Primary Examiner*—Jerry Smith

*Assistant Examiner*—Allen MacDonald

*Attorney, Agent, or Firm*—Body, Vickers & Daniels

[57] ABSTRACT

A system and method for adjusting the device used to exert a force against a strip being rolled by a rolling mill having at least one rotating backup roll. This system and method includes creating a signal F generally corresponding to force $F_O$ created by the device and the force $F_{ECC}$ caused by eccentricity and other variables in phase with the rotation of the backup roll, constructing an analog signal corresponding to the eccentricity signal by using an adaptive digital filter having a first digital input generally corresponding to the eccentricity force $F_{ECC}$, a second input correlated with the rotation of the backup roll and a coefficient adjusting algorithm responsive to the first input and a preselected convergence factor ($\mu$) and a correlated signal with an incremented value correlated with and driven by the rotation of the backup roll and adjusting the force exerting device by this constructed analog signal.

34 Claims, 16 Drawing Figures

FORCE TRANSDUCER (FRONT)
50
F = F0+(FECCA + FECCB)
-FECCT-
A=TOP
B=BOTTOM
INTEGRATER
130
F0
132
134
140
F0+FECCT-F0 ≅ FECCT
150
AESA
SinA/CosA
52
152
AESB
SinB/CosB
54
62
64
FECCA
FECCB
66
FECCT
70
160
ADJUST GAIN
162
72
(FRONT) POSITION REGULATOR (FORCE)
200
GAIN FECCT ≅ 0
202
204
F-95°/F
140
134
214
F
50
95%
210
D
212

FIG. 3A $$\mu \cos wt = \Delta A$$
$$\mu \sin wt = \Delta B$$

$$A_N = A_{N-1} + \mu \epsilon \cos wt$$

$$B_N = B_{N-1} + \mu \epsilon \sin wt$$

$$\cos wt\, A_N = \cos wt\, A_{N-1} + \mu \epsilon \cos^2 wt$$

$$\sin wt\, B_N = \sin wt\, B_{N-1} + \mu \epsilon \sin^2 wt$$

$$\hat{F}_{ECC(TOP)} = \cos wt\, A_N + \sin wt\, B_N$$

$$\hat{F}_{ECC(TOP)} = \cos wt\, A_{N-1} + \mu \epsilon \cos^2 wt + \sin wt\, B_{N-1} + \mu \epsilon \sin^2 wt$$

$$= \cos wt\, A_{N-1} + \sin wt\, B_{N-1} + \mu \epsilon (\sin^2 wt + \cos^2 wt)$$

$$= \underbrace{\cos wt\, A_{N-1} + \sin wt\, B_{N-1} + \mu \epsilon}_{\text{ANC ALGORTHM}}$$

FIG. 2B

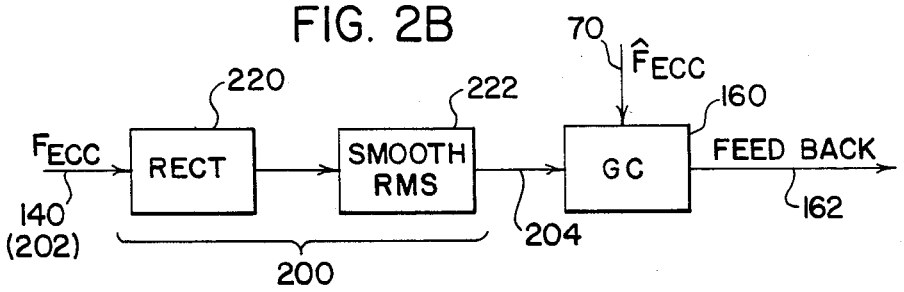

50
$F_O + F_{ECC}T$
232
$\epsilon$ = ERROR = $F_O + F_{ECC} - \hat{F}_{ECC}$
234
ERROR → MINIMUM
236
240
$\mu$ (SET)
$\mu\epsilon$
140
$F_{ECC}T$
62
$\hat{F}_{ECC}$
280
261
271
230
264
266
262
$\Delta B$
B
B'
Z-1
268
B · Sin wt
A · Cos wt
A
$\Delta A$
A'
250
252
260
270
t IS SAMPLE PERIOD (1/1000 REV)
Sin (wt) VECTOR
Cos (wt) VECTOR
52

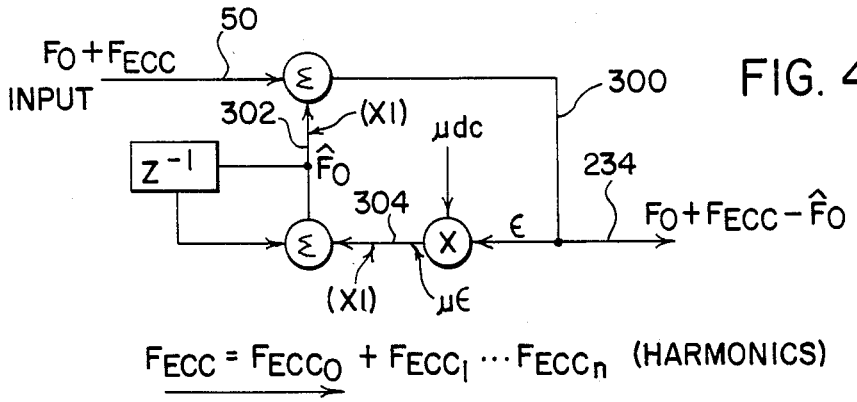
FIG. 4
$F_{ECC} = F_{ECC_O} + F_{ECC_1} \cdots F_{ECC_n}$ (HARMONICS)
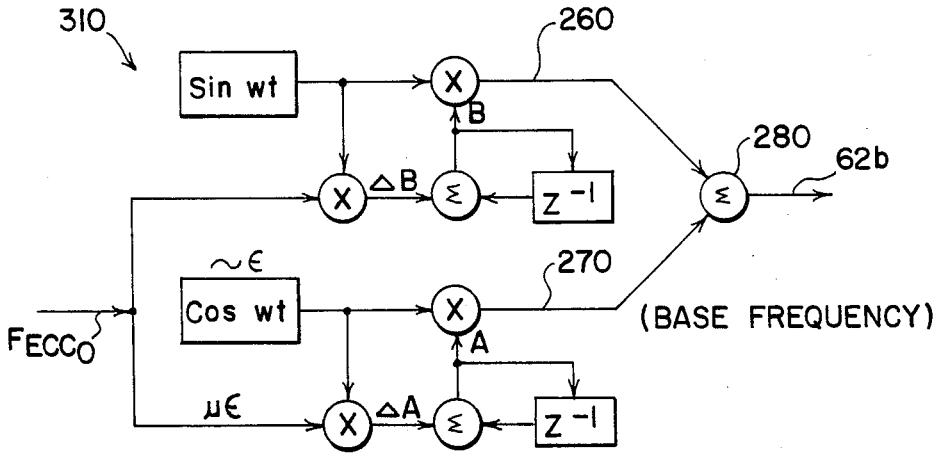
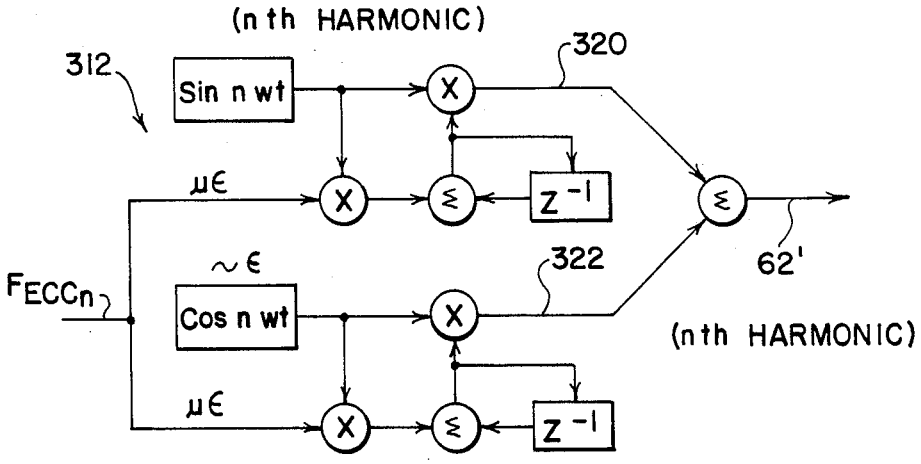

METHOD AND SYSTEM FOR GENERATING AN ECCENTRICITY COMPENSATION SIGNAL FOR GAUGE CONTROL OF POSITION CONTROL OF A ROLLING MILL

DISCLOSURE

The present invention relates to the art of creating a compensation signal corresponding to the eccentricity component of the total force exerted by a rolling mill against a metal being rolled for the purpose of controlling the thickness and uniformity of the metal and more particularly to a method and system of generating an eccentricity compensation signal for a gauge control or position control system of a rolling mill installation. The influence of backup roll eccentricity and other periodic variables is removed from the rolled metal strip.

INCORPORATION OF REFERENCES

The following U.S. Letters Patents are incorporated by reference in this application:

| | |
|---|---|
| Howard | 3,543,549 |
| Shiozaki | 3,709,009 |
| Cook | 3,881,335 |
| Fox | 3,882,705 |
| Ichiryu | 3,889,504 |
| Ichiryu | 3,928,994 |
| Ichiryu | 4,036,041 |
| Paul | 4,052,559 |
| Smith | 4,126,027 |
| Paul | 4,177,430 |
| King | 4,222,254 |
| Hayama | 4,299,104 |

Also incorporated by reference is an article entitled "Control Equations for Dynamic Characteristics of Cold Rolling Tandem Mills" from Iron and Steel Engineer Year Book 1974 and an article entitled "Adaptive Digital Techniques for Audio Noise Cancellation by James E. Paul (IEE Circuits and Systems Magazine, Volume I, No. 4, pages 2–7). The above mentioned patents and articles relate to eccentricity compensating devices and digital filter concepts which form the background information for certain aspects of the present invention. In Hayama U.S. Pat. No. 4,299,104 the working rolls of a rolling mill are brought into contact with each other, placed under load and rotated without the strip. In this operation, there is a digital memorization of the eccentricity induced by the backup roll. This memorized information is employed for subsequent extraction of eccentricity variables from the force being applied against a strip being processed by the mill. Other patents relating to systems wherein information is obtained before actual operation of the rolling mill and then employed for eccentricity control are Smith U.S. Pat. No. 4,126,027, Fox U.S. Pat. No. 3,882,705 and Cook U.S. Pat. No. 3,881,335. These systems require storage of data prior to mill operation. These systems present some difficulties. Actual variations encountered during a normal run can not be anticipated. Extra set up time, steps and skills are required. Such systems can not compensate for out of phase relationships between cooperating backup rolls.

In King U.S. Pat. No. 4,222,254, data regarding force and other parameters is accumulated and processed by a Fourier function. This system anticipates the primary frequencies of eccentricity and can be used in cancellation of this frequency; however, this system involves complex mathematical formulas and requires at least one complete revolution before the eccentricity signal can be locked into step with the eccentricity. Variations during the continuous run of a strip will not be corrected rapidly if at all. Eccentricity can not be distinguished from force variables. Another system employing accumulated data with a Fourier processor is Shiozaki U.S. Pat. No. 3,709,033.

These several patents do present information on the many efforts to solve eccentricity problems, disclose the standard operating factors and parameters of rolling mills, illustrate gauge control formulas and relationships and provide substantial background information which need not be reproduced in this specification.

Howard U.S. Pat. No. 3,543,549 and FIG. 9 of the article "Control Equations for Dynamic Characteristics of Cold Rolling Tandem Mills" by Watanaba appearing in the 1974 Year Book of Iron and Steel Engineer employ a sine and cosine relationship created by the backup rolls for processing eccentricity signals in a corrective system. The coefficients employed in the use of the sine/cosine relationship are fixed and are not adaptive for purpose of continuously correcting eccentricity during operating runs.

Ichiryu U.S. Pat. No. 3,889,504, Ichiryu U.S. Pat. Nos. 3,928,994 and 4,036,041 relate to techniques employing various feedback loops for the purposes of thickness control by compensating for variations caused by backup roll eccentricity and other uncontrolled phenomena. These three patents employ digital filters; however, they are pass band type filters so that the center of the frequency response curve of the filters is generally fixed. These digital filters are operated as filters so that the digital information passed through the units is excluded unless it is generally in the center of the pass band. The most relevant of these patents is Ichiryu U.S. Pat. No. 4,036,041 wherein two separate digital signals are processed by straight through filters. (See FIG. 4). The filters are separated by an intermediate analog integrator to adjust the center of the pass band; however, these integrators are operated in advance and are not adaptive.

Paul U.S. Pat. No. 4,052,559 discloses an adaptive digital filter and the coefficient adjusting algorithm as employed in accordance with one aspect of the present invention. The adaptive noise cancelling concept or algorithm is shown in Paul U.S. Pat. No. 4,177,430. These two patents relate to digital filters and are incorporated by reference herein for background information so that the mathematical theory and formulas need not be repeated in this specification.

BACKGROUND OF INVENTION

The present invention relates to a method and system of generating an eccentricity compensating signal of the type used in either a gauge meter or a position control scheme for a rolling mill installation and it will be described with particular reference thereto; however, it has much broader applications and may be used in other types of rotary equipment and in various other systems for eccentricity compensation in a rolling mill. Indeed, the invention may be employed in other manufacturing processes wherein there is to be compensation for a periodic force fluctuation correlated to or created by a rotary element.

In hot and cold rolling mills the eccentricity of the backup roll or rolls causes substantial difficulties, one of which is variation in the gauge of the strip being rolled. This is caused by a change in the opening between the working rolls during the processing of the workpiece, work or strip. This problem is becoming more pronounced as the specification for strip thickness from a rolling mill becomes more stringent. Indeed, competition in such industries as the steel industry has been devastating and mills seek orders on the basis of price and dimensional stability of metal strip. This accentuates the need for precise control which is difficult to obtain with massive, somewhat imprecise machines such as rolling mills. Also, some tolerance specifications have a tendency to preclude existing mills from consideration because of the inability to deal with roll eccentricity. There is a tremendous demand for a system to allow existing mills (purchased when speed was the basic requirement) to be used in the present market where speed must be accompanied by extreme uniformity. The many proposed eccentricity control systems have not met the need. Indeed, they generally anticipate a new mill with little eccentricity problems.

When the backup rolls are several feet in diameter and must be periodically reconditioned by a grinding process, surface undulations and/or eccentricities are unavoidable. Since most mills include two backup rolls engaging the outer surfaces of the work rolls, the eccentricity of both backup rolls causes variations in the strip gauge thickness, which variation may be in phase or out of phase. Indeed, even if in phase, slippage or other variations can cause the strip rolling variables caused by the surface of the backup rolls to become angularly displaced.

Because of the variables caused by eccentricity and other surface variations of the backup rolls, rolling mills often employ some type of position control or automatic gauge control added to the normal system for controlling the rolling mill. These systems attempt to compensate for fluctuations in the delivered gauge caused by rotational variations in the backup rolls. In many of these systems, the mill is adjusted for a normal run and the position control, gauge control or gauge meter system monitors and corrects for gauge errors or force variations during the actual rolling operation. These control systems generally employ some type of feedback loop to sense variations in some parameter and to take corrective actions. When using a gauge meter, the force signal from a load cell is monitored as an indication of gauge variation. As the gauge increases, or a harder surface is presented at the roll opening, there is an increase in the force exerted by the backup roll against the work roll. This increased force is sensed by the gauge meter and signals for a change in the displacement of the rolls in a direction to increase the roll force further to establish the proper gauge. The reverse of this occurs if the gauge or thickness increases or softer material is presented to the roll. The same general arrangement is employed for position control; however, it does not generally require consideration of the modulus of the material which is indicative of harder or softer material being processed through the rolling mill. In either system, eccentricity of the backup roll produces a periodic increase and decrease of the roll force as the rolls rotate. When the eccentricity causes an increase in the roll force, without any compensation, the automatic gauge control interprets this condition as an increase in the gauge or material hardners. This is not true. Consequently, a signal to increase the applied force is created. This signal compounds the errors in delivery gauge caused by roll eccentricity. The reverse occurs when eccentricity causes a decrease in roll force being measured by a load cell. These shortcomings are well known in the art of operating rolling mills. A substantial number of techniques has been employed to overcome the persistent problems created by backup roll eccentricity and the demand of the industry for tighter tolerances of the delivered strip. Systems which could theoretically operate in accordance with prior product tolerances are now not considered as viable systems to obtain the required tolerance control on a massive rolling mill.

The patents incorporated by reference into this specification illustrate the general type of systems employed for compensation of the force variations caused by backup roll eccentricity. Some of these systems are predictive in nature. In that situation, the work rolls are forced together and a force reading for one or more revolutions of the backup rolls is recorded. This is considered background data for eccentricity compensation. These systems are not successful. For instance, the backup rolls can be shifted with respect to each other due to differences in outer diameters, slippage or other variables between two backup rolls. This existing condition ultimately destroys the background force pattern of predictive systems. Another manner of attacking the complex problem of eccentricity in rolling mills is the use of a system which periodically stores a bulk of information and processes it in a Fourier processor. This processor produces a spectrum which is employed for eccentricity compensation. As can be seen, these continuously operating systems require an accumulation of data before any action can be taken on eccentricity; therefore, there is a substantial time lag between variations and actual correction. This type system continuously processes eccentricity by memorizing the variations and updating a control system. The predictive and memorized data concepts, although they can theoretically be of assistance in the problem of gauge control to eliminate eccentricity variations, have not been successful and are not now employed successfully in the rolling mill art. This fact can be explained by the massive equipment and gauge control demands for current product. Consequently, there is still a tremendous demand for a system which will compensate rapidly for in-process variations caused by eccentricity of the backup rolls during the actual processing of the strip, irrespective of changes in the strip modulus, input gauge and other factors employed in both position control, automatic gain control and gauge meter systems. In view of the deficiencies and costs of prior compensating systems, whether analog or digital, rolling mills still generally employ only gauge meters and position controls without effective eccentricity compensation and with a product that is often out of specification.

Mechanical devices have been attempted as low cost arrangements for backup roll eccentricity. Another suggestion, which has been made for solving the problem of roll eccentricity, is the provision of a filter for passing a signal including both the general steady state force and eccentricity force components. By adjusting the filter with a pass band generally centered around the roll frequency and providing a high Q factor, the output of these filters can be an approximation of the eccentricity force component. These filters, both analog and digital, are not accurate enough. The frequency can vary so that the Q must be enlarged to allow normal operation. When this occurs, there is no precise signal passing the filter. To allow a more accurate filtering process, it is suggested that the force measured by the load cell, which includes both the steady state force component and eccentricity force component, can be multiplied by either a sine or cosine of the backup roll rotation. By then centering the pass band with respect to the frequency of the sine wave caused by rotation of the backup roll, a more precise separation can occur between steady state component and the eccentricity component of the force being measured or monitored from the load cell. These forward pass band filters, digital or otherwise, are generally shown in Ichiryu U.S. Pat. No. 4,036,041. This patent also describes the difficulty with pass band filtering concepts. The pass band and the center of the band are controlled only from history and there is no feedback through the filtering loop itself. This type of system is generally employed with the standard BISRA-AGC gauge meter formula which was developed to exclude from gauge control the constantly variable, generally impercise material modulus. Thus, the systems are generally not applicable to the position control wherein material modulus is a factor. Consequently, these gauge meter systems must be manually adjusted for each material and for its prior processing.

As a summary, many patents have been obtained and many more systems have been suggested for removing eccentricity in the proper algebraic relationship from a rolling mill for the purpose of precise gauge control. Generally, the tolerances have decreased more rapidly than obtainable precision has increased in these systems. Consequently, at this time there is still a demand for an accurate, continuous, low cost and durable system for removing eccentricity variations from the control of the thickness of metal being processed by a rolling mill. In addition, the system must be applicable to control systems other than the standard gauge meter which has less application to the rolling mill art. The system must be fast operating and responsive in a small rotational angle of the backup roll.

THE INVENTION

The present invention overcomes the difficulties discussed with respect to prior attempts to remove the eccentricity component from a rolling mill operation which can be employed with the gauge meter concept, position control concept and other control arrangements. The system is continuous in operation, is not based upon a calibration force spectra, does not require data accumulation over long periods of time, and is adapted for use in digital control systems of the type employing microprocessors or mini-computers. In accordance with the present invention, there is provided a system, and method, for adjusting the device that exerts a force against a strip being rolled by a rolling mill, which mill includes at least one rotating backup roll. The system and method includes means for creating a signal F generally corresponding to the force ($F_O$) created by the force exerting device and the force ($F_{ECC}$) caused by eccentricity and other variables in phase with rotation of the backup roll, digital means for constructing an analog signal corresponding to the eccentricity force ($F_{ECC}$), wherein the digital means is an adaptive digital filter having a first digital input generally corresponding to the eccentricity force ($F_{ECC}$), a second input correlated with the rotation of the backup roll and a coefficient adjusting algorithm responsive to the first input and to a preselected convergence factor and correlated signal with an incremented value correlated with and driven by the rotation of the backup roll, and means for adjusting the device by the constructed analog signal.

By employing this system and method, the adaptive digital filter actually constructs an analog signal which is representative of the eccentricity force from the load cell of the rolling mill. This reconstructive force signal is continuously updated. As will be apparent in the preferred embodiment, this updating is based upon a sampling time which, in the preferred embodiment, is approximately 1/1000 th of a rotation of the backup roll. This can be obtained by providing a pulse generator which creates 1,000 pulses upon each rotation of the backup roll. In this manner, the filter is updated from the input signal each sample time which, in practice, is 1/1000 of a revolution. This is continuous in operation as this term is employed in this disclosure. Indeed, continuous operation indicates that the adaptation occurs at least several times during a single rotation of the backup roll. This differs from prior art wherein it is necessary for at least one complete rotation of the backup roll for updating a force creating signal. It is difficult to construct an analog control signal where sampling occurs only once every revolution. This is especially true in a digital processor. By providing several, in practice 1,000, sample times for a given rotation, an analog signal can be created which can be used to compensate for eccentricity, both in a gauge meter system and a position control system. The control system can read the analog signal and use it as a further feedback loop from the load cell to the position control device of the rolling mill. As is well known, the position control device is the force exerting device, such as an hydraulic cylinder having rapid response to requested changes in the force exerted on the strip through the backup rolls. The constructed signal can be a digitized analog system in view of the fact that there is a rapid sampling and updating of the output information which can be employed for the purpose of a gauge control environment associated with a rolling mill.

In accordance with another aspect of the invention, a method or system for eccentricity compensation employs a sine and/or cosine value to be incremented and used each 1/1000 of a revolution in an adaptive digital filter scheme. In this manner, the sine and cosine are the values correlated with the backup roll rotation. A stored digital value relating to a trigonometric function is outputted each 1/1000 of a revolution. This trigonometric value corresponds to either the sine or cosine of the angular position of the backup roll at a given sample time. For instance, the first sine or cosine incremented value could be sine of $\omega t$ angle corresponding to 1/1000 of a revolution, i.e. 360°/1000. The next outputted value could be sine corresponding to a value for an angle of 1/500 th of a revolution, i.e. 360°/1000×2 or 360°/500. This continues operation. The basic frequency can be correlated. By outputting every sine value (sin 360°/500, sin 360°/333 . . . sin 360° xn/1000 wherein n is an even number) the first harmonic can be created. By outputting each second sine value (sin 360°/1000×2 . . . sin 360°/1000 xn where n is evenly divisible by 2) the second harmonic could be processed. This procedure can continue to create a sine function correlated with various harmonics. Consequently, a digital filter could be provided for removing eccentricity forces correlated with various harmonics of the rotational speed of the backup rolls. The trigonometric function lends itself easily to digital processing since it presents known values which do not vary and still produce a correlated signal which can generate a constructed digital signal representative of the eccentricity induced force variations. Each harmonic of the roll rotation can be made a correlated signal without demanding a tremendous memory capacity. As can be seen, the adaptive digital filter can be adaptive with a minor amount of memory capacity since the correlation used for the adaptive coefficient selection process, is a finite number representing the sample time of the system, which in practice will be 1,000 per rotation of the backup roll.

In accordance with another aspect of the present invention, there is provided an automatic gain control feature for the method and system as defined above. This gain control feature employs the magnitude of the eccentricity force component ($F_{ECC}$) from the load cell to modify the magnitude of the constructed signal as it is used in the feedback loop of the standard gauge meter or position control of a rolling mill. This provides a simplified automatic gain control so that the constructed signal of the present invention has the desired impact upon the operation of the rolling mill to compensate for eccentricity force variations. Indeed, it has been established that even when the thickness of a strip passing through the rolling mill is changed, the compensation of the present invention occurs within less than one-fourth of a revolution of the backup rolls. This rapid lock in feature can be accomplished by an automatic gain control arrangement as contemplated in this further aspect of the present invention. A manual gain control could be used when the thickness of the strip being processed is to be intentionally changed; however, changes in thickness of strip being processed can be recognized and corrected at the force cylinder by using the automatic gain control feature provided by the present invention.

In accordance with another aspect of the present invention, the total force from the load cell, which includes a generally steady state force and the eccentricity force, is processed to remove the steady state force from the incoming signal before compensation is attempted. In this manner, only the eccentricity force (and a slight steady state force) is processed by the system of the invention so that all variables in the system have a relatively low magnitude. This is an improvement over the high magnitude processing required to process the total signal in the present invention or in prior gauge control systems. In a digital filter, of the adaptive type, the filter coefficients are adjusted to remove a correlated component of the input signal. The coefficients can be correlated and adjusted to a steady state more rapidly with a lower magnitude signal. This lower magnitude, in accordance with this aspect of the invention, is obtained by reducing the steady state component ($F_O$) of the total force ($F_O+F_{ECC}$). The operation to reduce $F_O$ can accomplished by an integrator, an adaptive filter, or any other system to remove and reduce the steady state component. Since the steady state component is a slowly variable DC signal in the total force signal, removal or reduction of the DC component in the total force will result in a signal ($F_O+F_{ECC}-F_O'$, where $F_O'$ is a DC component) generally corresponding to the eccentricity component $F_{ECC}$ of the total force. In the past, this eccentricity component was thought to be useful for the gauge control; however, that has been found to be unacceptable for reasons already discussed. In accordance with the invention, this separated signal ($F_O+F_{ECC}-F_O'$) is used to reconstruct digitally the $F_{ECC}$ component for use in the feedback loop. This has not been done in the past and produces the results and advantages realized by implementation of a method and system in accordance with the present invention.

In accordance with the invention, a digital, adaptive transversal filter is employed, this filter has adjustable coefficients changeable as a function of the total force signal (with or without DC reduction) in order to adaptively develop a least mean square estimate ($\hat{F}_{ECC}$) of the eccentricity force component ($F_{ECC}$).

The primary object of the present invention is the provision of a method and system of generating an eccentricity compensation signal to be used to compensate for the dynamic eccentricity component of the force exerted by backup rolls against a strip being rolled, which method and system can be used with a position control arrangement, a tension control system of strip gauge control, a gauge meter and any other arrangement for controlling the uniformity of strip thickness being processed in a rolling mill.

Yet another object of the present invention is the provision of a method and system, as defined above, which method and system employs a reconstructed or synthesized signal corresponding to the eccentricity component of the total force exerted by the backup rolls on the strip and wherein the constructed or synthesized signal includes a minimum, if any, amount of the steady state force employed for strip reduction.

Yet another object of the present invention is the provision of a method and system, as defined above, which method and system is continuous in operation and can compensate for variations occurring in substantially less than $\frac{1}{3}$ or $\frac{1}{4}$ of a revolution of either backup roll.

Still another object of the present invention is the provision of a method and system, as defined above, which method and system employs the concept of removing a portion, if not all, of the steady state force component in the total force being exerted by the backup rolls.

Another object of the present invention is the provision of a method and system, as defined above, which method and system employs a relatively limited number of data words or bytes to adjust the coefficients of an adaptive digital filter so that the digital filter can be employed for use in an eccentricity compensation system.

Still a further object of the present invention is the provision of a method and system, as defined above, which method and system employs an adaptive digital filter for the purpose of constructing the eccentricity component of the total force exerted by the backup rolls, which adaptive filter has coefficients controlled in accordance with stored data and delayed throughput data.

Yet another object of the present invention is the provision of a method and system, as defined above, which method and system employs a digital filter that is updated a number of times during a single revolution of the backup roll or rolls and which can be indexed, sampled or updated, by a pulse generator driven by the backup roll or rolls.

Another object of the present invention is the provision of a method and system, as defined above, which method and system employs a digital filter which is updated at sample times controlled by the rotational speed of the backup rolls.

Still a further object of the present invention is the provision of a method and system, as defined above, which method and system employs pulse signals to create sine and/or cosine functions for use in adjusting adaptive coefficients of a digital filter in accordance with the rotation of the backup rolls. The coefficients are adaptively adjusted as a function of the total force ($F_O+F_{ECC}$) to create a least mean square estimate ($\hat{F}_{ECC}$) of the eccentricity force ($F_{ECC}$).

Still a further object of the present invention is the provision of a method and apparatus, as defined above, which method and apparatus is self-calibrating, is not predictive in operation, can be used in a digital system without large memory capacities and can process eccentricities which may be out of phase, may change in phase and may otherwise be non-reoccurring even though correlated with the rotation of the backup rolls.

Another object of the present invention is the provision of a method and system, as defined above, which method and system includes two stages, one of which is controlled by the upper backup roll and the other of which is controlled by the lower backup roll in a four high rolling mill.

Yet a further object of the present invention is the provision of a method and system, as defined above, which method and system employs an adaptive digital filter which does not operate on the basis of a pass band or adjustable pass band and which can be used for any one of the harmonics according to the sample rate required during processing.

Another object of the present invention is the provision of a method and system, as defined above, which can be used generally and does not require elimination of the material modulus as is required in the BISRA gauge meter technique.

These and other objects and advantages will become apparent when considering the introductory portion and the description of the preferred embodiment of the present invention taken together with the accompanying drawings.

BRIEF DESCRIPTION OF DRAWINGS

In the disclosure, the following drawings are incorporated:

FIG. 2B is a block diagram of a further modification of the concept illustrated in FIG. 2A;

FIG. 3A is a group of formulas illustrating the mathematical relationships employed in adjusting the filter coefficients employed in the digital filter shown generally in FIG. 3 and employed in the preferred embodiment of the present invention. This relationship adaptively develops a least mean square estimate of the noise signal which is the eccentricity component ($F_{ECC}$). These relationships are the algorithm known as adaptive noise cancellation for transversal adaptive filters;

FIG. 4 is a flow chart illustrating how the embodiment of the present invention can be operated for the purpose of removing eccentricity noise components relating to several harmonics generated by rotation of the backup rolls;

PREFERRED EMBODIMENTS

Figure 1:
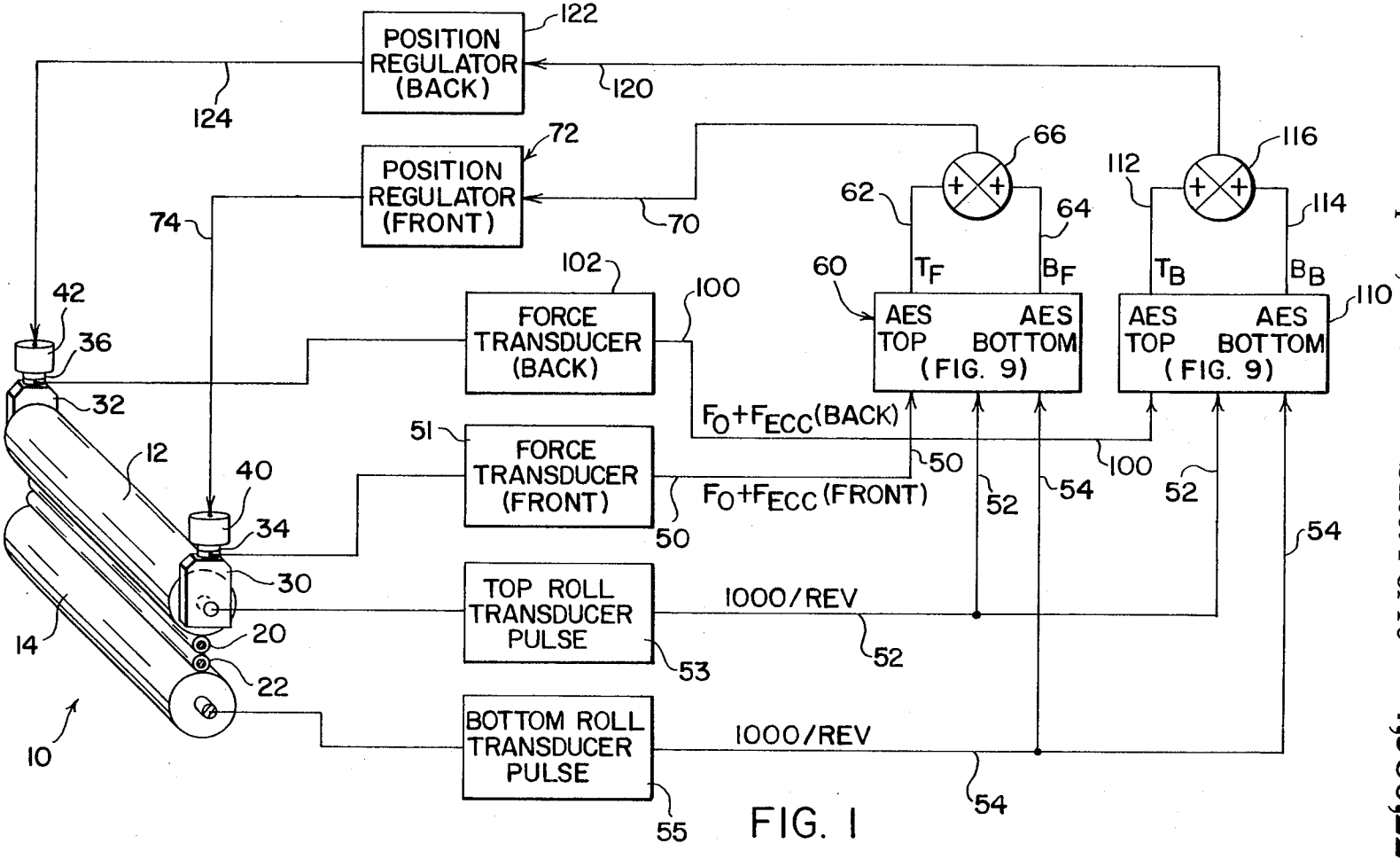
FIG. 1 is a block diagram of the preferred embodiment of the present invention employed in connection with a pictorial view of the rolls, chocks, load cells and position adjusting devices of a four high rolling mill.

Referring now to the drawings wherein the showings are for the purpose of illustrating preferred embodiments of the invention only and not for the purpose of limiting same, FIG. 1 shows a four high rolling mill 10 of the type having an upper backup roll 12 and a lower backup roll 14. The standard working rolls 20, 22 are forced together by the backup rolls which are controlled by a front chock 30 and rear or back chock 32. Load cells 34, 36 are transducers to detect the amount of force applied by the backup rolls against a strip being rolled through work rolls 20, 22. Although the force can be created by mechanical screws and other devices, in the illustrated embodiment, hydraulic force creating devices 40, 42 are employed for modulating the pressure applied by the backup rolls 12, 14 against the work or strip as the work rolls are rotated. In accordance with standard practice, one or both of the backup rolls can be driven. Irrespective of the particular mechanism, both backup rolls rotate during operation of the mill so that eccentricity caused by each roll is transmitted to the work or strip through the work rolls. To remove variations caused by backup roll eccentricity, the hydraulic forces created by devices 40, 42 are controlled. In the preferred embodiment, there is a front and rear eccentricity compensation system. The front system is operated in accordance with the signal in line 50 from transducer 51. The signal in line 50 is the total force signal ($F_O+F_{ECC}$) and is electrical with a steady state or lowly variable DC component ($F_O$) and an eccentricity component ($F_{ECC}$). Pulse generator 53 produces a pulse each 1/1000 th of a revolution in the upper backup roll 12 in line 52. In a like manner, generator 55 creates pulses each 1/1000 th of a revolution of the bottom backup roll 14 in line 54. These three signals, the total force in line 50, pulses in line 52 and pulses in line 54 are directed to a constructed signal or synthesized signal generator 60 produced in accordance with the present invention. The constructed or synthesized signals in lines 62, 64 are essentially pure reconstructions (estimates) of the eccentricity component $F_{ECC}$ from the total force generated as a signal in line 50. The constructed, estimated or synthesized eccentricity signal in line 62 corresponds to the eccentricity force component attributed to the backup roll 12. In a like manner, the constructed, estimated or synthesized eccentricity component signal in line 64 is the signal correlated with the bottom backup roll 14. The two signals in lines 62, 64 are combined at summing junction 66 to create a total control signal in line 70 which is employed for the purpose of regulating the hydraulic force in hydraulic force creating device 40. A somewhat standard regulator 72 uses the synthesized, estimated or constructed signal in line 70 to create the desired force signal in line 74. In this manner, force is controlled to compensate continuously for the eccentricity detected from the front of rolling mill 10. The force detected by load cell 36 at the rear or back of the rolling mill is employed for the purpose of adjusting the hydraulic pressure in device 42 at the back side of rolling mill 10. This system employs a force transducer 102 to create a total force ($F_O$+-$F_{ECC}$) in line 100. This force is introduced as an input to the constructed, estimated or synthesized signal generator 110 which is the same as signal generator 60 and is constructed in accordance with the present invention. Constructed, estimated or synthesized signals are created in lines 112, 114 and are correlated with the upper or top and lower or bottom backup rolls 12, 14, respectively. Summing junction 116 combines estimated or constructed, eccentricity components in lines 112, 114 so that a total control signal is created in line 120. This signal is the same type of signal as created in line 70 and is employed by position regulator 122 for the purpose of creating a fluid control signal 124 that controls the pressure exerted on the workpiece or strip by device 42. The signals in lines 70, 120 are constructed and/or synthesized reproductions (a least mean square estimate) of the eccentricity components in the total force signals in lines 50, 100. In accordance with the invention, these signals in lines 70, 120 have the various force components in the total force signals (lines 50, 100) eliminated. The only remaining signals in lines 70, 120 are components which are correlated in some fashion with the rotation of backup rolls 12, 14. Being more specific, the signals in lines 70, 120 are least mean square estimates of force components correlated with backup roll rotation as simulated by the sine and cosine functions. As was explained earlier and as will be discussed later, this correlation with rotation (sine/cosine) can be first and subsequent harmonics. The invention anticipates the creation of the basic frequency correlated signal ($\hat{F}_{ECC}$); however, an overlay of forces relating to various harmonics could be employed without departing from the present invention. By using a transversal digital filter with the coefficients adaptively changed by a signal correlated with the eccentricity component ($F_{ECC}$) a least mean square estimate ($\hat{F}_{ECC}$) can be created. This is a constructed or synthesized signal duplicating the actual eccentricity force and excluding steady state signal components because they are not correlated with rotation.

Figures 2, 2A:
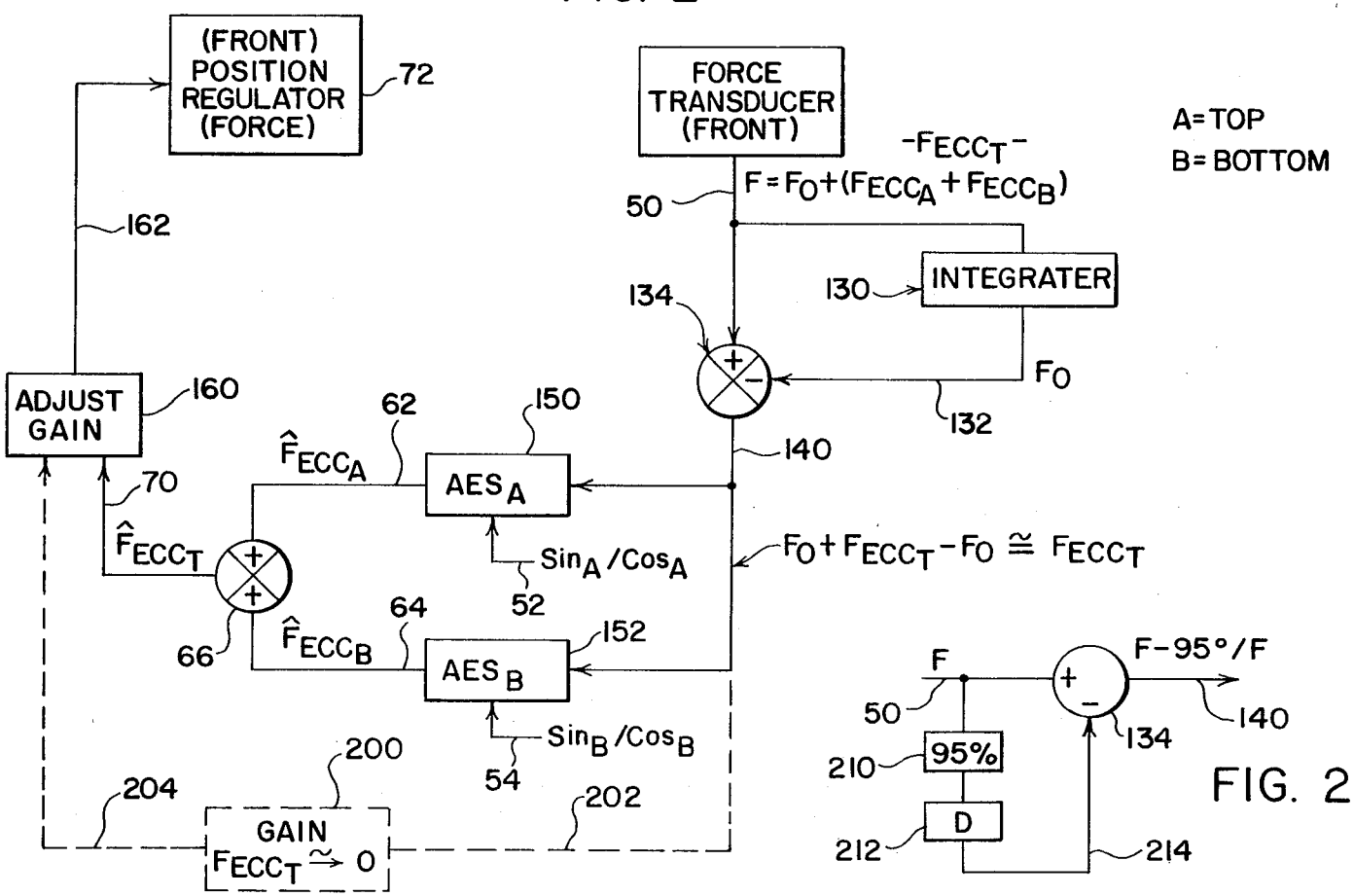
FIG. 2 is a block diagram of a portion of the preferred embodiment as generally shown in FIG. 1, which portion controls the front side of the rolling mill.
FIG. 2A is a partial block diagram illustrating a modified arrangement for reducing the steady state component from the signal created by the load cell in the preferred embodiment of the present invention.

Referring now to FIG. 2, more details of the preferred embodiment of the invention are illustrated together with a gain control feature. Line 50 causes the total force signal F which is directed to an integrator 130 having an output 132. The integration is controlled to remove the undulating or variable eccentricity component so that essentially the steady state force $F_O$ remains. The signal ($F_O$) in line 132 is directed to a summing junction 134 so that the output 140 is essentially the eccentricity component ($F_{ECC}$) of the total force in line 50. There is some stray influence of $F_O$ therefore $F_{ECC}$ is not pure. This signal ($F_{ECC}$ with some $F_O$ influence) is directed to the input of adaptive error simulators 150, 152 constructed in accordance with the present invention and employed for the purpose of the present invention. These simulators are within signal generator 60 and are employed for the top and bottom rolls, respectively. The output of adaptive error simulators 150, 152 are the signals in lines 62, 64 which are each least mean square estimates of an eccentricity force components (i.e, $\hat{F}_{ECC}$). The component from simulator 150 is the component correlated with the top roll since the sine and cosine attributed to upper roll 12 form the correlated input at line 52. In a similar manner, the constructed or synthesized eccentricity (least mean square estimate) component in line 64 is a duplicate or reconstruction of that component associated with the bottom roll 14 since the sine and cosine of the bottom roll is directed to simulator 152 by input line 54. The separate and distinct upper and lower estimated, constructed or synthesized eccentricity components associated with the top and bottom rolls are combined by summing junction 66 to produce the constructed signal in line 70. This is an improvement over prior devices in that the eccentricity is selected and reconstructed for both the top and bottom backup rolls. These are then combined to produce a total eccentricity correcting signal duplicating the eccentricity characteristics of the top and bottom backup rolls. In view of this, the relative angular relationship between the top and bottom rolls or any variation thereof is not required. The estimates are analyzed separately and distinctly. Then they are combined mathematically at the summing junction for the purpose of providing a total reconstructed or synthesized eccentricity duplicating signal in line 70. This eccentricity signal is for the front side of the rolling mill. A similar arrangement is provided to produce the total eccentricity signal in line 120 for the rear or back of the rolling mill 10. By using the present invention, a signal with any portion not associated with rotation of a backup roll is removed. This gives a pure eccentricity signal that is a reconstruction or simulation. Indeed, this pure signal is a least mean square estimate of the eccentricity signal as created by an adaptive noise canceller wherein the eccentricity is treated as noise to be estimated. The present invention uses the noise estimate whereas an adaptive noise canceller wants to remove the noise. As another difference, rotation is used as the correlator for the estimate.

To assure rapid correction of distinct force variations, as caused by sudden changes in input thickness or material modulus, there is provided a gain control 160 as shown in FIG. 2. This gain control can be manually adjusted by an operator to produce the desired effect of the estimated or reconstructed signal in line 162 for correcting the operation of the backup rolls. In accordance with an aspect of the invention, an automatic gain control 200 can be provided. This control has an input line 202 and an output line 204. The input line is controlled essentially by the level of the total eccentricity component in the signal appearing in line 50. Automatic gain control 200 attempts to reduce this eccentricity component in line 50 to a minimum. Thus, the magnitude of the signal in line 204 determines the amount of gain accomplished by gain control 160 to cancel eccentricity induced components in the force exerted on the work or strip. In accordance with the concept illustrated in FIG. 2, the steady state or slowly varying DC component in the total force signal (F) is reduced by integrator 130. This reduction does not change the phase or relative magnitude of the AC component of the total force signal (F). Thus, the adaptive error simulators 150, 152 operate on a relatively low signal level which is essentially the component responsive to eccentricity ($F_{ECC}$). This causes the coefficients in the adaptive digital filters employed in simulators 150, 152 to be changed more rapidly to produce the desired constructed output signals in lines 62, 64 in a lesser time. Other arrangements could be used for removing or reducing the effect of the steady state or DC level in the signal on line 50. One of these arrangements is illustrated in FIG. 2A. A summing junction 134 having an output 140, as previously described, is controlled by device 210 which passes 95% of the signal in line 50. This signal is then delayed by a standard delay subroutine or other device 212 for the purposes of creating a signal in line 214 which is generally 95% of the signal in line 50. This produces a relatively reduced signal in line 140 which still has the eccentricity component ($F_{ECC}$) for both the top and bottom rolls. Other arrangements could be provided for reducing or otherwise eliminating the effect of the steady state portion of the signal in line 50.

Referring now to FIG. 2B, there is a system to be used for the gain control device 200 to adjust the output of gain control device 160. In accordance with this concept, the signal in line 140 is first rectified. Since the signal is correlated with the sine wave, this rectified signal can be smoothed to produce a level generally relating to the magnitude of the variations in line 140. This level can be smoothed by a filter and the RMS taken. This produces an output in line 204 which has a steady state magnitude to adjust the gain of the control device 160. Of course, other arrangements could be employed for using the actual eccentricity force to control the magnitude of the estimated, constructed or synthesized eccentricity force signal in line 162.

Figure 3:
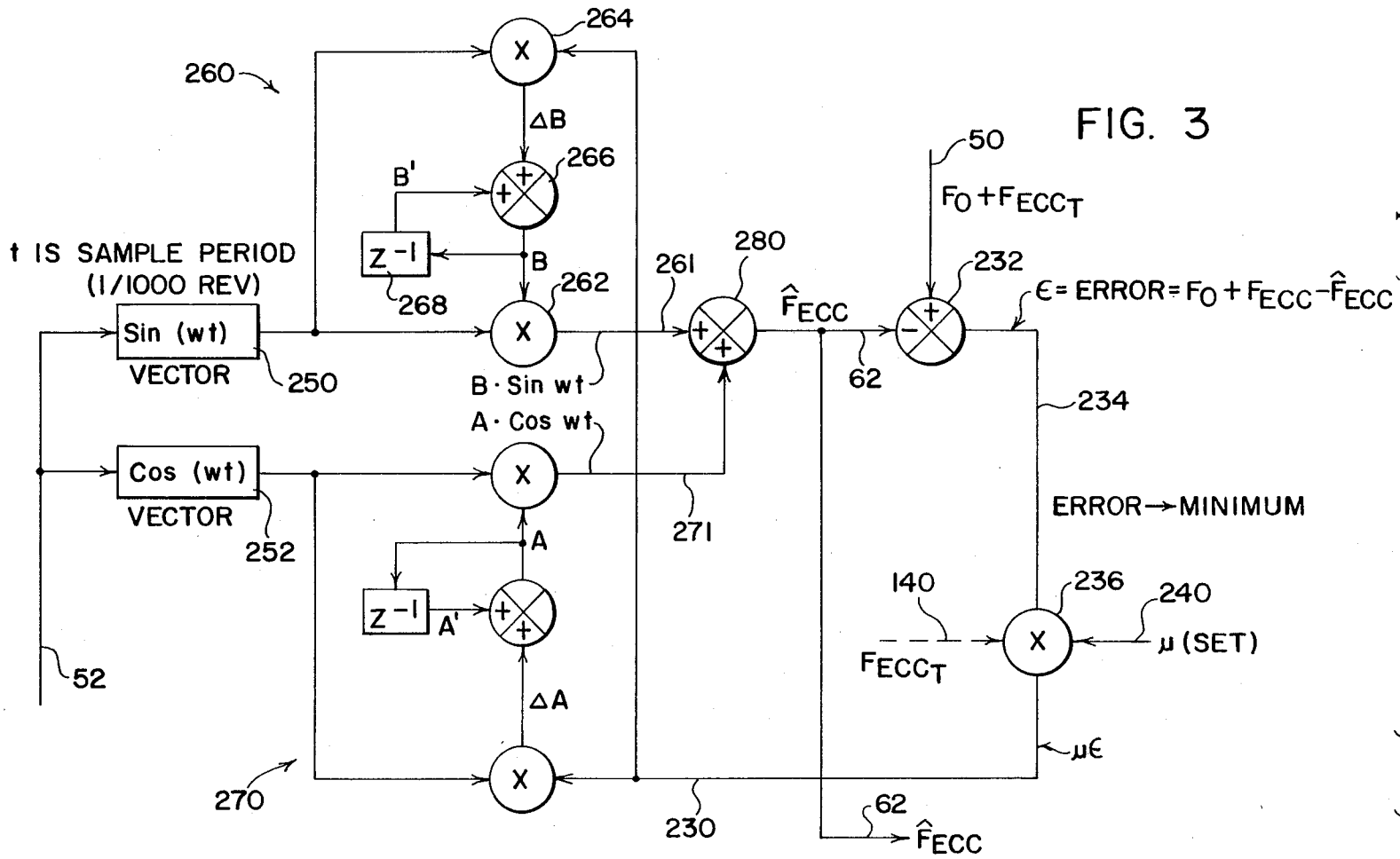
FIG. 3 is a flow chart illustrating the mathematical relationships employed in one channel of the preferred embodiment illustrated in FIG. 1.

The internal mathematic and functional operation of the adaptive error simulators 150, 152 is set forth in FIG. 3 and the basic algorithm employed is set forth in FIG. 3A. This algorithm adjusts or changes the coefficients for the digital filtering set forth in FIG. 3 in accordance with the sine and cosine relationship. This algorithm changes coefficients A, B as a function of error signal F to adaptively develop a least mean square estimate of eccentricity component ($F_{ECC}$). This coefficient changing concept is specifically set forth in Paul U.S. Pat. No. 4,052,559, and in Paul U.S. Pat. No. 4,177,430. (These patents are incorporated by reference). In accordance with the present invention the "noise" to be estimated by the adaptive filter includes the eccentricity component ($F_{ECC}$). The coefficients are multipliers of a signal correlated with the eccentricity components, i.e. with rotation of the backup rolls. In practice the correlated signal is a function of the sine or cosine of the angular position of the backup rolls.

The two patents relating to adaptive filters employ the adaptive digital filter for the purpose of noise cancelling in voice communication. The present invention employs the same type of system having different inputs and different correlated signals so that the output can estimate, construct and/or simulate the input error signal ($F_{ECC}$). As shown in FIG. 3, the error input is at line 230. The correlated signal input are pulses in line 52. The constructed signal output is the $\hat{F}_{ECC}$ in line 62. When an integrator or other arrangement is employed for removing or reducing steady state or DC component in the total force signal (F), line 140 could be used as a substitute for line 230. In that situation, the error signal is the total eccentricity force and the estimated, constructed or synthesized signal in line 62 attempts to reduce that error signal to zero. This can be done only by a correlation signal, which is the sine or cosine of the rotational movement of the top backup roll 12 as sensed by a series of pulses in line 52. Each pulse represents a small fixed amount of angular displacement. In practice, this displacement is 1/1000 th of a revolution. As discussed earlier, the error signal in line 230 could be the signal in line 140 with the steady state reduced. This is indicated in the dashed line of FIG. 3. Irrespective of the source of the error signal, the summing junction 232 includes an input corresponding to the signal in line 62. This is the estimate signal ($\hat{F}_{ECC}$). The output of summing junction 232 is line 234 which has the basic error signal E. This error is multiplied by a preselected gain ($\mu$) in line 240 to produce the product ($E\mu$) in line 230. This product is the product of the signal in line 240 ($\mu$) and the error in line 234 (E). Consequently, the rate at which the adaptive error simulator converges with the error signal and is latched to a desired output signal ($\hat{F}_{ECC}$) in line 62 is controlled by the level of the signal ($\mu$) in line 240. This signal is set and remains the same; however, it is possible to provide arrangements for changing the gain factor which would affect the rate of convergence of the signal in line 62 with the error appearing in line 230 which is from line 234 or from line 140.

The pulses in line 52 have a rate corresponding to the rotational velocity of top backup roll 12. These pulses index vector generators 250, 252 to control branches 260, 270 in a manner correlated with the sine of the top roll displacement or the cosine of the top roll displacement, respectively. Vector generator 250 and the upper branch 260 employing coefficient B will be described in detail. This description applies equally to the cosine vector generator 252 and its relationship with branch 270 as controlled by coefficient A. Branch 260 includes multipliers 262, 264, a summing junction 266 and a delay network or circuit 268. The output 261 is the multiple of the existing coefficient B and the sine vector (or value) from generator 250. This signal is added to the signal in line 271 from branch 270 at junction 280. This produces a total estimated, constructed or synthesized signal ($F_{ECC}$) representing the eccentricity force associated with the upper or top backup roll 12. Upon each pulse in line 52, a digital value corresponding to sine $\omega t$ is directed to the input of multipliers 262, 264. Multiplier 264 multiplies the level of error $\mu\epsilon$ in line 230 with the outputted sine value ($\sin \omega t$) from generator 250. This produces $\Delta B$. This signal, $\Delta B$, is added with the next previous coefficient B to produce a new coefficient B at the output of summing junction 266. This new coefficient is multiplied by the current output of vector generator 250 (sin $\omega t$) to produce the current signal in line 261. In practice, this process is done digitally; therefore, upon receipt of each pulse in line 52, the total system is updated. This is a sample time. The new coefficient B is obtained from summing junction 266 and it is then multiplied by the current output of vector generator 250 during the sample time. Until the error E is reduced to a minimum, this process continues. This occurs when $\Delta B$ reaches zero and the sine curve is locked into the magnitude of the eccentricity component ($F_{ECC}$). When this happens, the signal in line 62 ultimately becomes a signal opposite to the rotation of a related portion of the signal in line 230. This minimizes the error signal in line 230. The algorithm for selecting the coefficient is set forth in FIG. 3A. This is a mathematic relationship necessary to reduce the error to zero using a sine and cosine relationship. The coefficients A, B are changed in accordance with the standard adaptive noise cancelling algorithm using the sine and cosine values. Having these two features, the signal in line 62 can be made into the estimated, reconstructed or simulated signal necessary to reduce the value of the signal in line 234 to a minimum. This will be a reconstruction or simulation of the actual eccentricity signal included in line 50.

By using a system as shown in FIG. 3 for the adaptive error simulators 150, 152 of FIG. 2, the force exerted on the backup rolls is such to remove the effect caused by eccentricity variatons in the backup rolls. This process is not predictive, nor does it require memorizing or storage of data other than the vector data in generators 250, 252. This data is finite, fixed and does not require a substantial amount of memory capacity or changes according to ambient conditions.

Figure 3B:
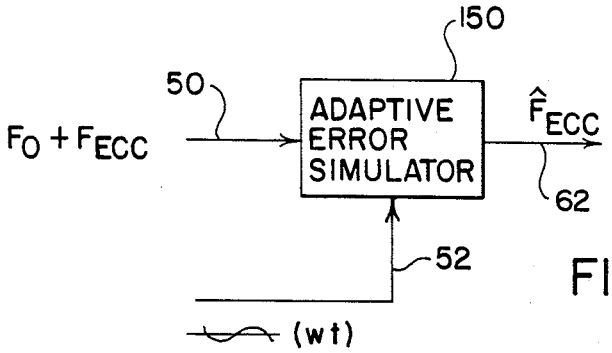
FIGS. 3B and 3C are block diagrams showing the use of the concept as illustrated in FIG. 3 and employed for construction and/or synthesization of two signals employed in the preferred embodiment of the present invention.
Figure 3C:
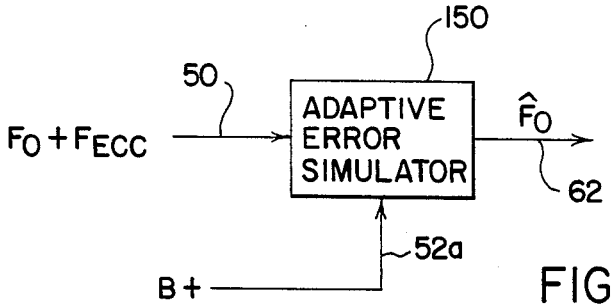

Referring now to FIGS. 3B and 3C, the adaptive error simulators 150, 152 can be employed for several purposes. The basic purpose is illustrated in FIG. 3B wherein the input 50 contains the "error" which can be either the steady state value $F_O$ or the eccentricity component $F_{ECC}$. The portion of this signal which is considered "error" to be estimated on a least mean square basis by adaptive error simulator 150 is determined by the correlation signal in line 52. If this signal is related or, i.e. correlated with, the eccentricity component, the estimated signal will be the eccentricity component by itself. Pulses in line 50 output vectors corresponding to sine and/or cosine. The "error" is considered to be the $F_{ECC}$ component and the output in line 62 is the estimated signal necessary for cancelling this error. Thus, the output is $\hat{F}_{ECC}$ in line 62.

Referring now to FIG. 3C, the same input is directed to adaptive error simulator 150 by line 50. The signal in line 52*a* is a constant level or voltage signal. This signal is a DC signal which correlates directly with the DC component $F_O$ of the incoming signal on line 50. Thus, the output in line 62 is an estimated, reconstructed, simulated error correcting signal $\hat{F}_O$. In this situation, pulses in line 52 are used only to define sample time. By directing an error signal corresponding to line 230 in FIG. 3 to the branches 260, 270, the output signal can be constructed in accordance with the correlation caused by the signal on line 52. When the input is to be steady state, the pulses in line 52, or 52*a*, are used only for the purposes of causing a sample to be taken to update the output in line 62. When the input is to be correlated with rotation of the backup roll, vector generators 150, 152 output the necessary digital data for implementation of the coefficient changing arrangement to create the desired eccentricity related signal in line 62. FIG. 3 is the standard adaptive noise cancellation configuration or architecture. The signal in line 50 corresponds to the "noise" signal at one input of an adaptive noise canceller. The signal in line 52 is the noise correlated input. The signal in line 230 is the error signal.

In adaptive noise cancelling, the output is generally the "error" in line 234. An adaptive noise canceller is modified for use in the invention so that the signal correlated to the noise to be extracted can be the output of vector generators 250, 252 in FIG. 3. Two separate and distinct adaptive noise cancelling circuits are then employed as the upper branch 260 and the lower branch 270. These are then totalized by a summing circuit or junction 280 to create a portion of the total signal in line 70 of FIG. 2. Thus, four separate adaptive noise cancelling networks or devices are employed to produce a signal in each of the lines 70, 120.

The diagram illustrated in FIG. 4 is the diagram to be used in practice to accomplish the functions so far described with respect to the preferred embodiments and in the introductory portion of this disclosure. Upper branch 300 has two of the multipliers used in branches 260, 262 omitted. In this manner, the error $\epsilon$ is multiplied by 1. This is indicated by x1 multipliers in lines 302, 304. Branch 300 corresponds to the branches 260, 270 of a standard adaptive noise cancelling architecture shown in FIG. 3 with the multiplier of components 262, 264 being 1.0. These branches are shown in Paul U.S. Pat. No. 4,177,430. By utilizing this steady state multiplier (1.0), branch 300 corresponds essentially to the schematic representation shown in FIG. 3C where the error is considered to be steady state or DC. Thus, the output signal in line 62*a* is a steady state signal adapted to cancel the steady state condition ($F_O$) in the input 50. Since branch 300 employs the error signal $\epsilon$, this signal corresponds to the "error" signal in line 234 of FIG. 3 instead of the estimated least mean square signal in line 62 of FIG. 3. Thus, the actual $F_{ECC}$ is created in line 234. This is obtained by subtracting the constructed force signal $\hat{F}_O$ from the total force signal ($F_O+\hat{F}_{ECC}$) in line 50. This signal corresponds to $F_{ECC}$ as used in line 140. The input to circuit 310 is the actual force on line 50 or a reduced force on line 140. It is not an estimated force. This is considered the "error" input of the two branches 260, 262 to produce an $F_{ECC}$ signal in line 62*b* at the output of junction 280. Additional circuits, such as circuit 312, include branches 320, 322. Constructed or synthesized eccentricity correcting signals are directed to lines 62' for each additional circuit. All signals can be combined before applying to a feedback device.

In the illustrated embodiment, branches 320, 322 are employed for the n harmonic of the top backup roll rotation. This is accomplished by taking samplings from vector generators 150, 152 that can output values at increments corresponding to $\omega t$ at each of N increments comprising a single revolution. In practice, N=1000. The input to branches 260, 270 includes at least the basic signal ($F_{ECCO}$) so the output in line 62*b* will be $F_{ECCO}$. Harmonic branches 320–322 have an input ($F_{ECCN}$) relating to a given harmonic correlated with the sin/cos $n\omega t$ signals. Thus, the output in line 62' will be the least mean square estimate of the nth harmonic ($\hat{F}_{ECCN}$) Any other component in the inputs to the processors 310, 312 of FIG. 4 will be ignored to give pure, constant signals for subsequent use in the rolling mill.

Figure 5:
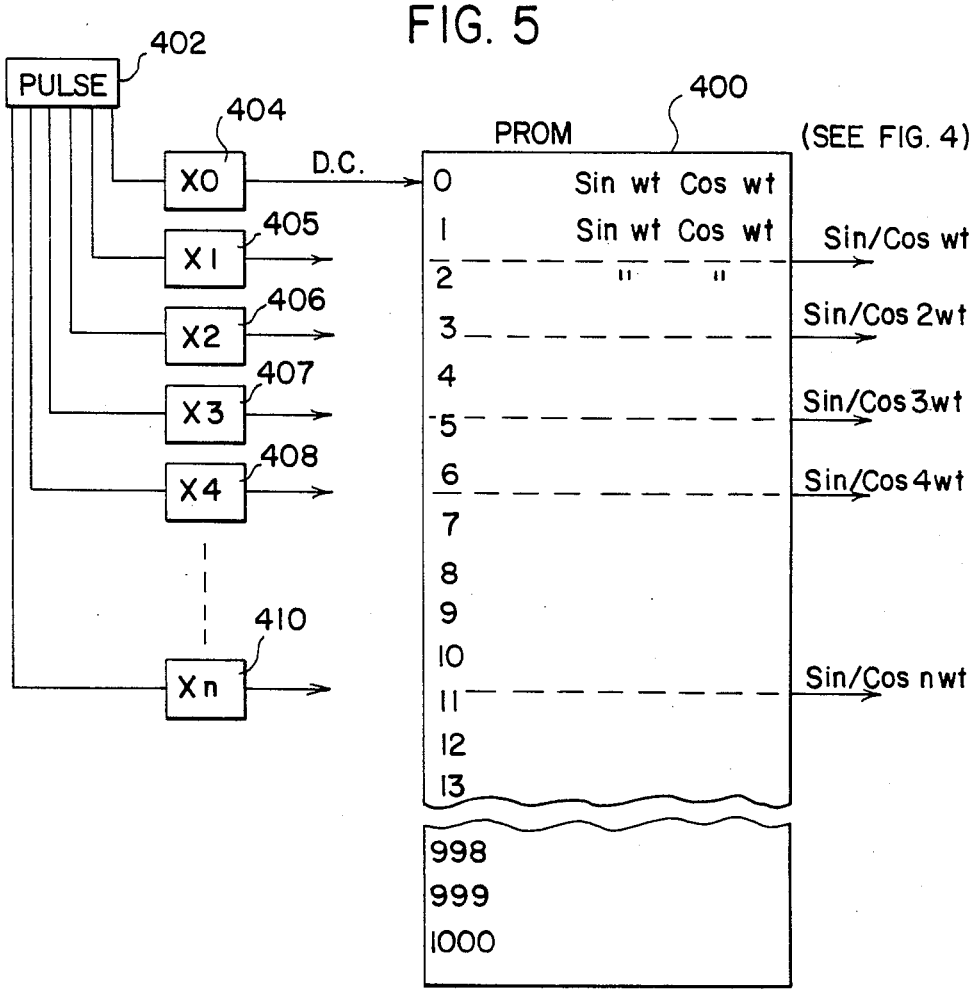
FIG. 5 is a block diagram illustrating the digital architecture employed for interfacing backup roll rotation with the correlation signal employed in the adaptive digital filter in the preferred embodiment of the present invention to allow a minimum data storage and a simplified input operating signal in the form of a pulse correlated with rotation of the backup roll or rolls.

To control operation of the circuits shown in FIG. 4, the PROM 400 of a computer memory bank is provided with the necessary sine and cosine functions for each desired increment of backup roll rotation. In practice, 1,000 pulses will be provided for each roll rotation. Thus, the PROM will have 1,000 separate and distinct sin $\omega t$ and cos $\omega t$ functions. At each pulse from the backup roll being monitored, a pulse is generated at the output of the indexing device 402. (See FIG. 5) A pulse is directed to each of the several multipliers 404–408 and 410. These multipliers determine which numerical value is selected and outputted from the PROM. Multiplier 404 relates to the steady state condition as used in the branch 300 of FIG. 4. Thus, neither a sine function nor a cosine function is outputted for multiplier circuit 404. With respect to multiplier 405, each pulse indexes or increments PROM 400 and outputs a different sine, cosine value. The first index will be for the sine and cosine of an angle represented by 1/1000 of a revolution. The next index pulse will cause the sine and cosine 2/1000, i.e. 1/500. The next index will be sine and cosine values for an angle of 3/1000 times a single revolution, i.e. 360° $\times$3/1000. As can be seen, each pulse from device 402 produces a sine and cosine increment by multiplier 405. These values form digitized sine and cosine curves related to rotation of the backup roll used for branches 260, 270, as previously described. For the next harmonic, multiplier circuit 406 is employed. In this instance, each pulse from device 402 is multiplied by two and causes that step or location of PROM 400 to be outputted. This outputs digitized curve relating to the second harmonic of rotation, i.e. sin 2 $\omega t$, cos 2 $\omega t$. Pulses from device 402 (driven by a backup roll) are multiplied by three in multiplier 407. Thus, when the first step of PROM 400 is outputted to form the sin/cos curve, multiplier 407 outputs step No. 3 of the PROM. At the second pulse device 402, multiplier 407 outputs step No. 6 of the PROM. This is continued sequentially through the map in PROM 400 to construct the sin 3 $\omega t$, cos 3 $\omega t$ curves to be used in the third harmonic processor of FIG. 4. This process produces sine/cosine values for $n\omega t$ for use in a branch of FIG. 4. Multiplier 410 produces the necessary value for inputs correlated with a harmonic of the backup roll being monitored. The signal from FIG. 5 will create an estimated, constructed or synthesized eccentricity signal for the particular harmonic selected by one of the multiplier circuits 404–408 and 410 and used in a selected branch of FIG. 3. By this system, at one increment a single value set for sine and cosine may be used. When harmonics are processed a multiple increment or step of PROM 400 is used for each harmonic.

Figure 6:
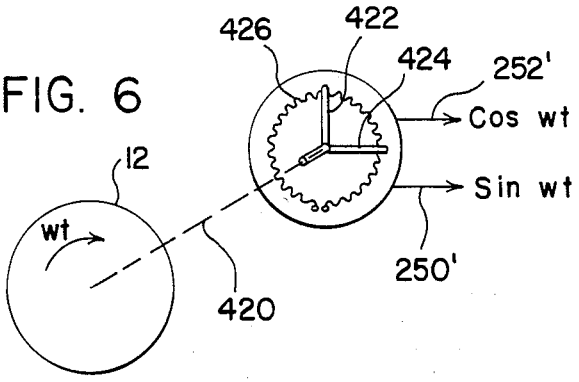
FIG. 6 is a schematic view of another arrangement to create signals correlated with rotation of a backup roll which arrangement could be employed in practicing the present invention and is an illustrated modification.
Figure 7:
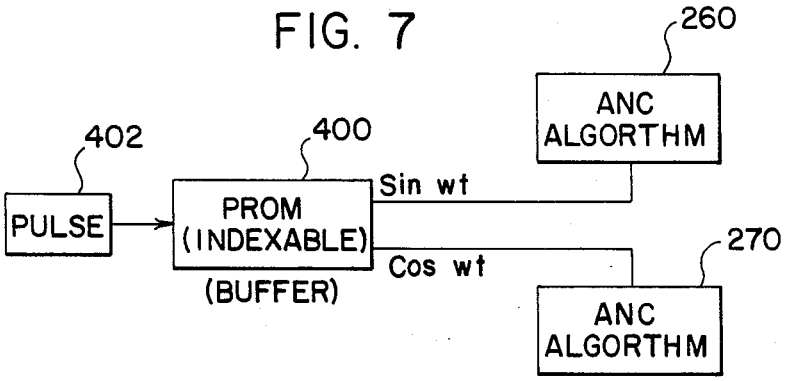
FIG. 7 is a block diagram showing the general operation of the digital architecture illustrated in FIG. 5.

FIG. 6 represents a modification of the preferred embodiment of the present invention wherein an analog signal corresponding to sine and cosine is generated. This is schematically illustrated as a shaft 420 driven in unison by roll 12. Two orthogonal wipers 422, 424 are rotated against rheostat 426 so that the output from these wipers corresponds to the sine and cosine of the angular position of roll 12. These analog signals are represented as lines 250′ and 252′ corresponding generally to the output of vector generators 250, 252 shown and described in FIG. 3. If this type of system is to be employed, the analog signals in line 250′ and 252′ can be digitized during a sampling time initiated by a pulse. In this instance, the pulse can be by a separate and distinct pulse generator so that the pulses determine the sampling time in a manner quite similar to the operation of the branch 300 shown in FIG. 4. This branch employs pulses from the roll only for the purposes of causing updating of digital data within the branch. FIG. 7 is an illustration of the relationship between the pulse generator 402, PROM 400 and the adaptive noise cancelling algorithms employed in branches 260, 270 as shown in FIG. 3. Other arrangements could be incorporated for employing a simulated or actual sine/cosine for the correlated input of an adaptive noise cancelling architecture employing adaptive digital filters as shown in the patents by Paul and incorporating by reference herein.

Figure 8A:
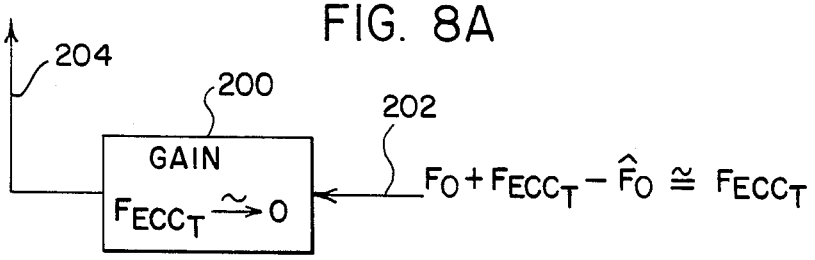
FIGS. 8A–8C are schematic block diagrams illustrating the digital architecture and schemes for use in certain areas of the preferred embodiment of the present invention; and, FIG. 9 is the position control diagram used in the preferred embodiment of the present invention to control either the front or back hydraulic control device of a rolling mill. Two of these systems are employed in the preferred embodiment illustrated in FIG. 1.
Figure 8B:
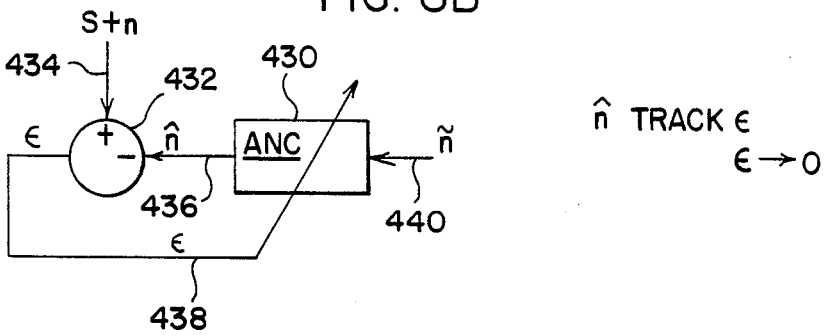
Figure 8C:
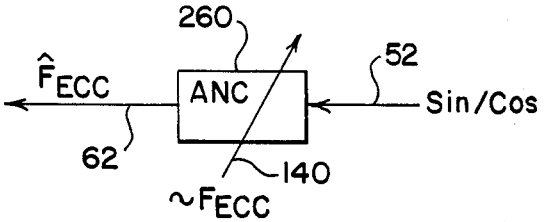

Referring to FIGS. 8A, 8B and 8C, block diagrams of certain aspects of the invention are employed for illustrative purposes only. For instance, in FIG. 8A, the automatic gain control 200 is illustrated as operating to control the output of 204 in accordance with the input 202. Various circuits could be employed for this purpose to make the system an automatic gain control system. FIG. 8B is a standard schematic layout for an adaptive noise canceller. In this layout, the adaptive noise canceller 430 employs the summing junction 432. One input to this junction is a signal having a noise component as represented by line 434. The other input to the summing junction is the least mean square estimated noise signal $\hat{n}$ in line 436. These two signals are subtracted to produce an error $\epsilon$ in line 438. This error $\epsilon$ is processed by the adaptive noise canceller in a manner to reduce error to a minimum. Since the incoming signal in line 434 has two components, a signal correlated with noise n must be provided at input 440. By correlating the signal with the noise n in line 434, the adaptive noise canceller can reduce the error $\epsilon$ in line 438 to a minimum by removing as much as possible of the noise component n in signal s+n. Thus, the attractive value $\hat{n}$ in line 436 is a least mean square estimate or constructed duplicate of the actual noise n in signal 434. As can be seen, the input to canceller 430 defines what is considered noise for an adaptive noise canceller. Indeed, if the incoming correlated signal in line 440 were in fact correlated with the incoming signals, the signals themselves would be considered noise by the processor 430 so that the output in line 436 would be a least mean square estimate $\hat{s}$ of signal s, as opposed to the unwanted noise n. The output of this type of device is generally the error $\epsilon$ in line 438. If the incoming signal on line 440 were correlated with the desired signal in 434, the error in 438 would in fact be the noise n. These concepts are employed in the present invention by using a generated sine and cosine function as the correlated input on line 440. Since this is correlated with the eccentricity component ($F_{ECC}$) in the total force ($F_O+F_{ECC}$), eccentricity ($F_{ECC}$) is considered "noise" and is reduced toward zero. This produces a least mean square estimate or constructed signal $F_{ECC}$ in line 436. This signal is used in a gauge meter, position control system, tension control system or other arrangement for controlling the gauge of metal strip (such as steel) passing between work rolls of a rolling mill to remove inconsistencies and variations caused by eccentricities and other variations correlated with the rotation of one or more of the backup rolls. By producing signals correlated with each backup roll, phasing of the backup rolls and compensation for differences in diameters are not required. FIG. 8C illustrates the concept employed in the present invention wherein the eccentricity in line 140 ($F_{ECC}$) can be considered "noise" in an adaptive noise canceller branch 260. This noise signal ($F_{ECC}$) is definitely correlated with the sine and cosine functions generated by pulses in line 52. Thus, line 62 contains a least mean square estimate or constructed eccentricity signal ($\hat{F}_{ECC}$). It is impossible to extract all of the eccentricity component ($F_{ECC}$) for use in line 140; however, the present invention assures a nearly exact duplication of the eccentricity force component in output line 62. The noise canceller changes coefficients A, B of each dual channel to assure removal of any steady state residual. This can not be done by other proposed systems to separate $F_{ECC}$ from the total force $F_O+F_{ECC}$. This advantage has not been obtainable by other circuits employing eccentricity controls since they generally attempt to isolate and pass the actual eccentricity component $F_{ECC}$.

Figure 9:
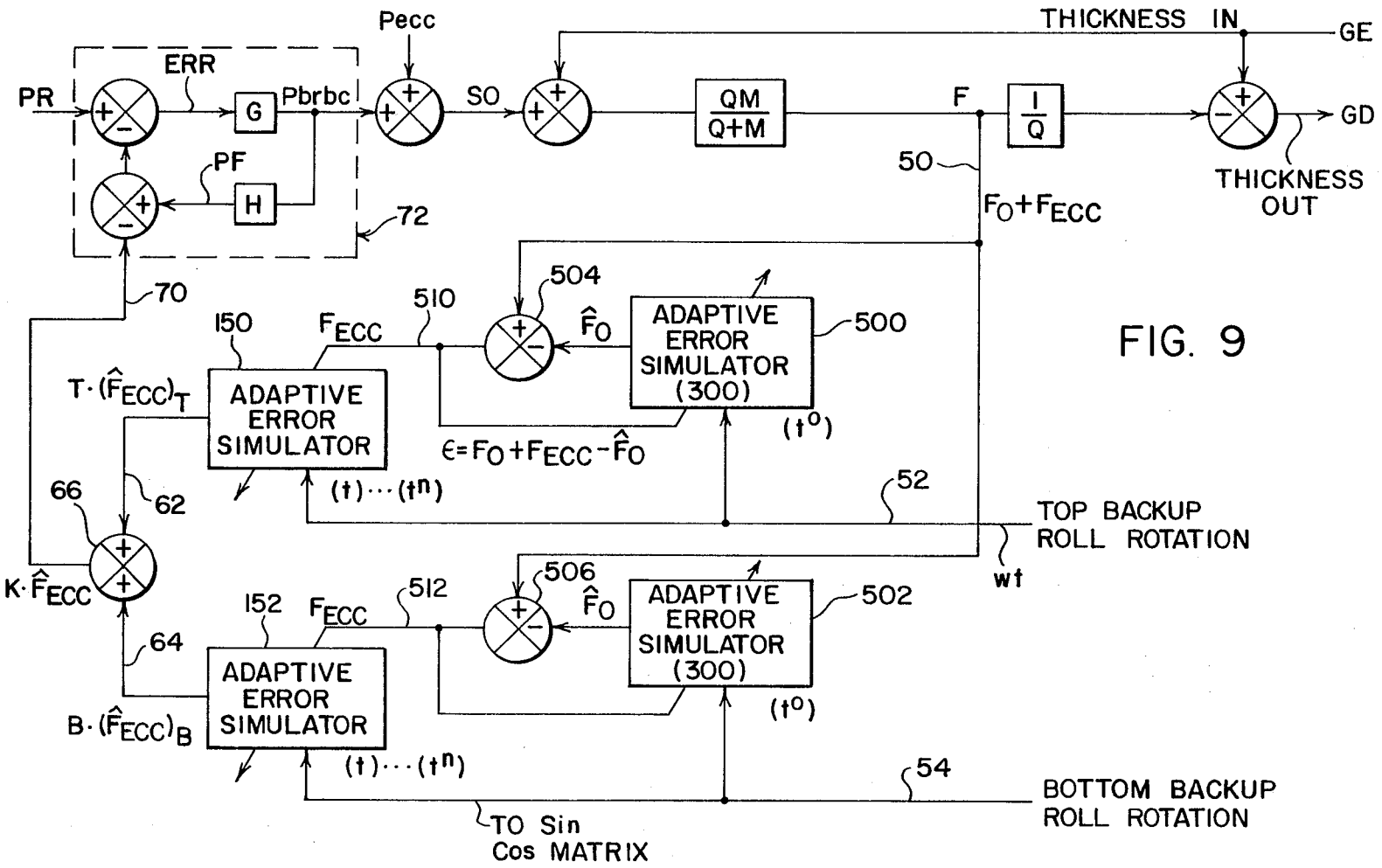

Referring now to FIG. 9, the system as now contemplated for using the present invention is schematically illustrated in a standard position control shown at the top of the diagram. In accordance with standard practice, the following legend is employed:

PR—Position Reference (volts)
PF—Position Feedback (volts)
ERR—Position Regulator Error (volts)
G—Position Regulator Forward Gain (inches/volt)
H—Position Regulator Feedback Gain (volts/inches)
Pbrbc—Backup Roll Bearing Chock Position (inch)
Pecc—Backup Roll Surface Position (with Respect to Backup Roll Bearing Chock (inch)
SO—Unloaded Mill Roll Gap (inch)
GE—Entry Strip Thickness (inch)
Q—Material Modulus (pounds/inch)
M—Mill Modulus (pounds/inch)
F—Rolling Force (pounds)
GD—Delivery Strip Thickness (inch)

The operation of the preferred embodiment, as shown in FIG. 9 is quite apparent. The various components contain the same numbers as used in the earlier disclosure. The adaptive error simulators 500, 502 are of the type shown as branch 300 in FIG. 4. The error directed to simulator 500 502 is $F_O+F_{ECC}-\hat{F}_O$. By employing the pulses in lines 52, and 54 as samplers only, the correlated signal to simulators 500 and 502 is a steady state. Thus, the error is constructed as $\hat{F}_O$. The outputs in lines 510 and 512 ultimately become the actual eccentricity force component $F_{ECC}$. Pulses in lines 52, 54 are correlated with the error so that the estimated, reconstructed or simulated output of the adaptive error simulators 150, 152 are the least mean square estimates of the eccentricity force components from the top and bottom backup rolls, respectively. These estimated or constructed signals are combined by summing junction 66 to create a signal in line 70. This signal is directed to the position regulator 72. In practice the signal will be analog by the time it controls force changes against the backup rolls. The regulator 72 includes a box "G" which is the actual control of the position of the work rolls. This control decreases the force by appropriate valving when eccentricity force in line 70 increases. Within a short time, the force in line 70 will be opposite to the eccentricity induced force. Then $\hat{F}_{ECC}$ is equal and opposite to $F_{ECC}$ and only $F_O$ is applied against the strip. As previously mentioned, the preferred embodiment of the present invention as now anticipated in FIG. 9 could be used in a standard gauge meter using the BISRA formula or another arrangement to compensate for eccentricity variations in the backup roll.

As can be seen, the present invention is updated continuously so that eccentricity variations are identified rapidly and corrected without the need for substantial storage when the system or method is performed digitally. In essence, there is an instantaneous indication of roll eccentricity force which can be used in a feedback loop to adjust the valve for the hydraulic system employing force on the strip being rolled. By using the present invention, two separate channels or branches can be used for discrimination between the roll eccentricity forces from top and bottom backup rolls. In this manner, there are no problems introduced by phasing of roll eccentricity forces by differences in roll diameters and by slippage between two backup rolls. This invention does not depend upon its operation by the gauge meter formula or any other formula. The invention is a separate feedback loop to attack and solve the basic problem created by backup roll eccentricities. Automatic gain control becomes possible using this system without deviation or modification of the basic system being controlled. Although the preferred embodiment of the invention is to be used in a digital system, it is appreciated that the concepts are also viable in analog environment. Digital operating mode is to be employed because adaptive noise cancellers are available and can be incorporated with the modifications set forth in the preferred embodiments of the invention in a system for outputting the sine and cosine characteristics as a function of input pulses. This feature is one aspect of the invention which allows the use of an adaptive noise canceller device in an environment which does not involve sound or other voice processing.

Referring again to FIG. 3, the value of the signal in line 240 is considered a convergence coefficient and the product contained in line 230 is the convergence gain. This convergence gain is multiplied with the sine and cosine signals to produce products known as the adaptation coefficients $\Delta A$, $\Delta B$. The $\Delta A$, $\Delta B$ changes in coefficients are added to terms referred to as the value of the previous term filter coefficients A', B'. A', B' are the values of A, B delayed by one sample period determined by pulses in line 52. Then the new filter coefficients are A, B. Thus, the adaption coefficients $\Delta B$, $\Delta A$ which are controlled by the error in line 230 update the outputs of multiplier 262 until the error in line 230 is minimized. This arrangement produces a least mean square estimate of a correlated signal in accordance with known techniques.

Although the position regulator as shown in FIG. 9 is used in most rolling mills, the adaptive eccentricity cancellation system has applications in other rolling mill gauge control loops. The invention can be used in parallel with a standard gauge meter control method. The gauge meter uses an outer control loop with the position regulated rolling mill of FIG. 9. The gauge meter control system makes use of the rolling mill stand as the means of measuring existing gauge thickness. The exit gauge of a rolling mill is described by the following equation:

$$h=S+F/M$$

where h=Exit Strip Thickness (inches)
S=Unloaded roll gap (inches)
F=Roll force (pounds)
M=Mill spring modulus (pounds/inch)

The gauge meter algorithm makes use of the incremental aspects about an operating point of the above equation, thus yielding $\Delta h = \Delta S + \Delta F/M$ By removing $F_{ECC}$ from $\Delta F$, changes in force will result in gauge changes when the unloaded roll gap change $\Delta S$ is to be zero. This system requires a nearly pure representation of eccentricity which is obtainable by the present invention on a nearly instantaneous basis.

Having thus defined the invention, the following is claimed:

1. Method of generating and using an eccentricity compensation signal to compensate for the dynamic eccentricity component $F_{ECC}$ in the total force $F+F_{ECC}$ applied between two rotatable backup rolls engaging rotating work rolls in a rolling mill as the work rolls of said mill compress a metal strip passing between said work rolls, wherein F relates to the DC component of said total force, said method comprising the steps of:

(a) creating a signal proportional to said total force $F+F_{ECC}$;

(b) reducing said Dc component F of said total force signal to produce an intermediate signal generally corresponding in phase and magnitude to said eccentricity component $F_{ECC}$;

(c) providing a digital filter of the type operated by first and second input signals in accordance with an adaptive noise cancellation algorithm, wherein said first input signal is a noise correlated signal and said second input is an "error" signal having at least a portion correlated with said first input signal to produce a constructed output signal generally corresponding in magnitude and spectrum to said correlated portion of said second input whereby said constructed output signal attempts to reduce said second input to a minimum;

(d) creating a control signal correlated with rotation of at least one of said backup rolls;

(e) connecting said control signal as said first input signal to said digital filter;

(f) connecting said intermediate signal as said second input to said digital filter; and, (g) adjusting said total force applied between said two backup rolls by said constructed output signal from said digital filter.

2. A method as defined in claim 1 including the step of:

(h) adjusting the magnitude of said constructed output signal as a direct algebraic function of said intermediate signal.

3. A method as defined in claim 1 wherein said correlated control signal creating step includes:

(h) creating said correlated control signal by a signal corresponding to a trigometric function of the rotational angle $\omega$ of said backup rolls related to time t.

4. A method as defined in claim 3 wherein said trigometric function is the sine of $\omega$ at time t.

5. A method as defined in claim 3 wherein said trigometric function is the cosine of $\omega$ at time t.

6. A method as defined in claim 3 wherein said trigometric function is selected from the functions consisting of sine $\omega t$, cosine $\omega t$ and a combination thereof.

7. A method as defined in claim 1 wherein said correlated control signal creating step includes:

(h) storing a series of digital values in a digital memory device at positions 1 to x in integer sequence;

(i) creating a pulse each 1/x revolution of said one backup roll;

(j) outputting a different one of said digital values upon each of said pulses; and, (k) using said outputted digital value as said correlated control signal.

8. A method as defined in claim 7 including the additional steps of:

(l) providing a second digital filter corresponding to said previously mentioned digital filter;

(m) creating a second correlated control signal for said second digital filter;

(n) outputting a selected one of said digital values upon each pulse, said outputted digital values being each nth value stored in said memory device wherein n is an integer greater than 1; and, (o) using said outputted nth digital values as said second correlated control signal.

9. A method as defined in claim 8 wherein n is no more than 16.

10. A system for generating and using an eccentricity compensation signal to compensate for the dynamic eccentricity component $F_{ECC}$ in the total force $F+F_{ECC}$ applied between two rotatable backup rolls engaging rotating work rolls in a rolling mill as the work rolls of said mill compress a metal strip passing between said work rolls, wherein F relates to the DC component of said total force, said system comprising:

(a) means for creating a signal proportional to said total force $F+F_{ECC}$;

(b) means for reducing said DC component F of said total force signal to produce an intermediate signal generally corresponding in phase and magnitude to said eccentricity component $F_{ECC}$;

(c) a digital filter of the type operated by first and second input signals in accordance with an adaptive noise cancellation algorithm, wherein said first input signal is a noise correlated signal and said second input is an "error" signal having at least a portion correlated with said first input signal to produce a constructed output signal generally corresponding in magnitude and spectrum to said correlated portion of said second input whereby said constructed output signal attempts to reduce said second input to a minimum;

(d) means for creating a control signal correlated with rotation of at least one of said backup rolls;

(e) means for connecting said control signal as said first input signal to said digital filter;

(f) means for connecting said intermediate signal as said second input to said digital filter; and, (g) means for adjusting said total force applied between said two backup rolls by said constructed output signal from said digital filter.

11. A system as defined in claim 10 including means for adjusting the magnitude of said constructed output signal as a direct algebraic function of said intermediate signal.

12. A system as defined in claim 10 wherein said correlated control signal creating means includes means for creating a signal corresponding to a trigometric function of the rotational angle $\omega$ of one of said backup rolls related to time t.

13. A system as defined in claim 12 wherein said trigometric function is the sine of $\omega$ at time t.

14. A system as defined in claim 12 wherein said trigometric function is the cosine of $\omega$ at time t.

15. A system as defined in claim 12 wherein said trigometric function is selected from the functions consisting of sine $\omega t$, cosine $\omega t$ and a combination thereof.

16. A system as defined in claim 10 wherein said correlated control signal creating means includes means for storing a series of digital values in a digital memory device at positions 1 to x in integer sequence; means for creating a pulse each 1/x revolution of said one backup roll; means for outputting a different one of said digital values upon each of said pulses; and, means for using said outputted digital value as said correlated control signal.

17. A system as defined in claim 16 including means for providing a second digital filter corresponding to said previously mentioned digital filter; means for creating a second correlated control signal for said second digital filter; means for outputting a different one of said digital values upon each pulse, said outputted digital values being each nth value stored in said memory device wherein n is an integer greater than 1; and, means for using said outputted nth digital values as said second correlated control signal.

18. A system for adjusting the device for exerting a force against a strip being rolled by a rolling mill having at least one rotating backup roll, said system including:

(a) means for creating a signal F corresponding to a force ($F_O$) created by said device and a force ($F_{ECC}$) caused by eccentricity of said backup roll;

(b) means for substantially removing said force ($F_O$) from said signal F;

(c) digital means for constructing an analog signal corresponding to said eccentricity signal ($F_{ECC}$), said digital means being an adaptive digital filter having first digital input corresponding to said eccentricity force $F_{ECC}$, a second input correlated with the rotation of said backup roll and a coefficient adjusting algorithm response to said first input and a preselected convergence factor ($\mu$), said correlated signal having an incremented value correlated with with and driven by rotation of said backup roll; and, (d) means for adjusting said device by subtracting said constructed analog signal from said exerted force.

19. A system as defined in claim 18 wherein said incremental value is a sine or cosine value corresponding to the angular position of said backup roll as it is rotated.

20. A system as defined in claim 19 including automatic gain control for adjusting the relative magnitude of said constructed signal by said eccentricity force $F_{ECC}$.

21. A system as defined in claim 18 including means for reducing the component of said force signal F relating to said device created force ($F_O$) to provide an intermediate signal and means for directing said intermediate signal to said first digital input of said adaptive digital filter.

22. A system as defined in claim 18 wherein said correlated signal to said digital means is a signal representative of sine $\omega t$ wherein $\omega t$ is the angular position of said backup roll.

23. A system as defined in claim 18 wherein said correlated signal is representative of cosine $\omega t$ wherein $\omega t$ is the angular position of said backup roll.

24. A system for adjusting the device for exerting a force against a strip being rolled by a rolling mill having an upper rotating backup roll and a lower rotating backup roll, said system including:

(a) means for creating a signal F corresponding to a force ($F_O$) created by said device and a force ($F_{ECC}$) caused by eccentricity and other variables in phase with rotation of one of said bacjup rolls;

(b) means for substantially removing said force ($F_O$) from said signal F;

(c) digital means for constructing an analog signal corresponding to said eccentricity signal ($F_{ECC}$), said digital means being first and second adaptive digital filters each filter having an output, a first digital input corresponding to said eccentricity $F_{ECC}$, a second input correlated with the rotation of said one of said backup rolls and a coefficient adjusting algorithm responsive to said first input and a preselected convergence factor ($\mu$), said correlated signal having an incremented value correlated with and driven by rotation of one of said backcup rolls, said first filter employing a second input correlated with and driven by said uppper backup roll, said second filter employing a second input correlated with and driven by said lower backup roll;

(d) means for combining the output of each adaptive filter to provide said constructed signal; and, (e) means for adjusting said device by subtracting said constructed signal from said exerted force.

25. A control system for generating an eccentricity compensation signal to compensate for the dynamic eccentricity component $F_{ECC}$ in the total force $F+F_{ECC}$ applied between two rotatable backup rolls engaging rotating work rolls in a rolling mill as the work rolls of said mill compress a metal strip passing between said work rolls, wherein F relates to the DC component of said total force, said system comprising; means for creating a signal proportional to said total force $F+F_{ECC}$; means for reducing said DC component F of said total force signal to produce an intermediate signal generally corresponding in phase and magnitude to said eccentricity component $F_{ECC}$; an adaptive digital filter means for digitally reconstructing said eccentricity component $F_{ECC}$ as a signal at the output of said filter means by development of filter coefficients to reduce eccentricity component $F_{ECC}$ to a minimum; and means for adjusting said total force by said signal at the output of said filter means.

26. A control system for generating an eccentricity compensation signal to compensate for the dynamic eccentricity component $F_{ECC}$ in the total force $F+F_{ECC}$ applied between two rotatable backup rolls engaging rotating work rolls in a rolling mill as the work rolls of said mill compress a metal strip passing between said work rolls, wherein F relates to the DC component of said total force, said system comprising means for creating a signal proportional to said total force $F+F_{ECC}$; an adaptive digital filter means for digitally reconstructing said eccentricity component $F_{ECC}$ as a signal at the output of said filter means by development of filter coefficients to reduce eccentricity component $F_{ECC}$ to a minimum and, means for adjusting said total force by said signal at the output of said filter means.

27. A control system for a rotary device for transmitting a total force (F) including a steady state component ($F_O$) and a rotary correlated component ($F_{ECC}$), said system comprising:

(a) digital means for constructing an analog signal corresponding to said rotary correlated component, said digital means being an adaptive filter having a first input receiving a digital representation of said rotary correlated component ($F_{ECC}$), a second input receiving a digital representation of the rotation of said device, and a coefficient adjusting algorithm responsive to said digital representation at said first input, a convergence factor and said digital representation at said second input; and, (b) means for adjusting said rotary device by said constructed analog signal from said total transmitted force.

28. A system for generating and using an eccentricity compensation signal to compensate for the dynamic eccentricity component $F_{ECC}$ in the total force $F+F_{ECC}$ applied between two rotatable backup rolls engaging rotating work rolls in a rolling mill as the work rolls of said mill compress a metal strip passing between said work rolls to a preselected thickness, wherein F relates to the DC component of said total force, said method comprising:

(a) means for creating a signal proportional to said total force $F+F_{ECC}$;

(b) a digital filter of the type operated by first and second input signals in accordance with an adaptive noise cancellation algorithm, wherein said first input signal is a noise correlated signal and said second input is an "error" signal having at least a portion correlated with said first input signal to produce a constructed output signal generally corresponding in magnitude and spectrum to said correlated portion of said second input whereby said constructed output signal attempts to reduce said second input to a minimum;

(c) means for creating a control signal correlated with rotation of at least one of said backup rolls;

(d) means for connecting said control signal as said first input signal to said digital filter;

(e) means for connecting said intermediate signal as said second input to said digital filter; and, (f) means for adjusting said device by said constructed output signal to maintain said preselected thickness of said metal strip.

29. A system as defined in claim 28 including means for adjusting the magnitude of said constructed output signal as a direct algebraic function.

30. A system as defined in claim 28 wherein said correlated control signal creating means includes means for creating a signal corresponding to a trigometric function of the rotational angle $\omega$ one of said back up rolls related to time t.

31. A system as defined in claim 30 wherein said trigometric function is the sine of $\omega$ at time t.

32. A system as defined in claim 30 wherein said trigometric function is the cosine of $\omega$ at time t.

33. A system as defined in claim 30 wherein said trigometric function is selected from the functions consisting of sine $\omega t$, cosine $\omega t$ and a combination thereof.

34. A system as defined in claim 28 wherein said correlated control signal creating means includes means for storing a series of digital values in a digital memory device at positions 1 to x in integer sequence; means for creating a pulse each 1/x revolution of said one backup roll; means for outputting a different one of said digital values upon each of said pulses; and, means for using said outputted digital value as said correlated control signal.

* * * * *